United States Patent [19]

Jagst

[11] 4,258,453

[45] Mar. 31, 1981

[54] CARD FRAME

[75] Inventor: Peter Jagst, Mönchen-Gladbach, Fed. Rep. of Germany

[73] Assignee: Trützschler GmbH & Co. KG, Mönchen-Gladbach, Fed. Rep. of Germany

[21] Appl. No.: 927,356

[22] Filed: Jul. 24, 1978

[30] Foreign Application Priority Data

Jul. 22, 1977 [DE] Fed. Rep. of Germany ..... 2733095

[51] Int. Cl.[3] ..... D01G 15/28

[52] U.S. Cl. ..... 19/98

[58] Field of Search ..... 19/98, 99, 107, 102, 19/104, 105, 106 R

[56] References Cited

U.S. PATENT DOCUMENTS

| | | | |
|---|---|---|---|
| Re. 9,457 | 11/1880 | Estes | 19/98 |
| 19,011 | 1/1858 | Baldwin | 19/98 |
| 431,685 | 7/1890 | Canning | 19/104 |
| 700,164 | 5/1902 | Audette | 19/98 |
| 2,908,047 | 10/1959 | Lehman | 19/112 X |
| 3,071,820 | 1/1963 | Bettoni, et al. | 19/98 |
| 3,110,063 | 11/1963 | Ammerall | 19/106 R |
| 3,310,244 | 3/1967 | Ramo | 19/106 R |
| 3,375,555 | 4/1968 | Vinogradov et al. | 19/98 |
| 3,597,801 | 8/1971 | Varga | 19/98 |
| 3,992,755 | 11/1976 | Bonalumi | 19/106 R |
| 4,187,585 | 2/1980 | Lowe | 19/98 |
| 4,198,729 | 4/1980 | Harrison | 19/98 |

FOREIGN PATENT DOCUMENTS

| | | | |
|---|---|---|---|
| 257170 | 9/1911 | Fed. Rep. of Germany . | |
| 609287 | 6/1933 | Fed. Rep. of Germany . | |
| 390746 | 8/1965 | Switzerland . | |
| 983461 | 2/1965 | United Kingdom | 19/98 |

*Primary Examiner*—Louis Rimrodt
*Attorney, Agent, or Firm*—Spencer & Kaye

[57] ABSTRACT

A card has a frame including two parallel-spaced, rigidly supported side walls having lateral surfaces, a lickerin and a doffer disposed between the side walls and mounted on the lateral surfaces thereof; and carding organs situated between the lickerin and the doffer. At least some of these carding organs are, with their lateral end faces, disposed immediately adjacent the lateral surface of the respective side wall and are laterally mounted on the side walls.

10 Claims, 5 Drawing Figures

CARD FRAME

BACKGROUND OF THE INVENTION

This invention relates to a card having a frame which comprises two rigidly supported side walls. The roll components of the card are rotatably supported between the side walls and further, the lickerin, the doffer as well as rolls of the web delivering assembly downstream of the doffer are secured to the lateral faces of the side walls.

In known cards two parallel side walls of cast iron are provided. The frame in such cards consists of these two side walls and the connecting elements arranged therebetween which together with the side walls form a box-like structure. The two oppositely disposed bearings for the stub shafts of the main cylinder are designed as pillow-block bearings and are affixed, for example, by screw connection, to the upper bounding surfaces of the side walls. The pillow-block bearings have to be in exact alignment with one another because of the substantial flywheel moment of the rolls and the required accuracy regarding the spacing between the rolls. For this reason, the upper bounding surfaces of the side walls have to be machined to be completely planar and flush with respect to one another at identical heights. Further, the securing surfaces of the pillow-block bearings have to be machined with precision. Such machining operations involve substantial manufacturing expense. On each side between the pillow-block bearing and the associated radial face of the cylinder there is provided a lateral shield which constitutes a closed, arcuate surface which, in essence, shrouds the radial faces of the cylinder. The structural components extending beyond the external circumference of the lateral shield are exposed to lateral fly. The lateral shield has, in addition to an edge flange, radially extending ribs, the height of which increases from the shield periphery towards the hub. Such an arrangement provides a clearance between the pillow-block bearing and the respective end face of the cylinder. In the intermediate space constituted by this clearance between the side wall of the card frame and the lateral shield underneath the pillow-block bearing, dust may accumulate to a significant extent. Each side wall of the frame shrouds the cylinder only in the zone which extends from the floor to the pillow-block bearing. For this reason, the lateral shield, among others, serves the purpose of supporting particularly those carding organs which are arranged above the pillow-block bearings, such as for example the flexible bends and the support for the flat chains. The manufacture of the above-outlined lateral shields involve substantial expense. It is a further disadvantage of the above-outlined arrangement that the drives for the different carding organs require separate supports and covers. As a result, the known carding machines have pillow-block bearings and lateral shields which have to be separately manufactured and the assembly and mounting of which involves substantial expense; further, the carding organs between the lickerin and the doffer are exposed to lateral fly to a substantial extent.

SUMMARY OF THE INVENTION

It is an object of the invention to provide an improved carding machine from which the above-discussed disadvantages are eliminated and which thus is simpler to manufacture and assemble and which further provides an effective shrouding of the carding organs between the lickerin and the doffer and which makes it possible to provide a common support arrangement for the drive of the individual carding organs.

This object and others to become apparent as the specification progresses, are accomplished by the invention, according to which, briefly stated, the card has a frame including two parallel-spaced, rigidly supported side walls having lateral surfaces, a lickerin and a doffer disposed between the side walls and mounted on the lateral surfaces thereof; and carding organs situated between the lickerin and the doffer. At least some of these carding organs are, with their lateral end faces, disposed immediately adjacent the lateral surface of the respective side wall and are laterally mounted on the side walls.

The invention is founded on the basic consideration to secure the carding organs and structural elements disposed between the lickerin and the doffer, not to the top of the side walls as in the known arrangements, but to the lateral faces of the side walls. Thus, for this purpose, the invention provides that the lateral end faces of the carding organs and structural elements, such as the main cylinder, the flexible bends and the supports for the flats are immediately adjacent the inner lateral faces of the side walls of the card frame and further, the carding organs and structural elements are supported laterally in the side walls.

Thus, according to the invention, the card frame has two side walls made, for example, of steel plates, which are immediately adjoining the carding organs and the carding organs are supported by means of their shafts or mounting elements, on the lateral surfaces of the side walls. Therefore, the expensive pillow-block bearings and lateral shields by means of which heretofore the carding organs had to be mounted on the top of the side walls are dispensed with in the card structured according to the invention. Thus, according to the invention, the side walls are either in part or in their entirety extended upwardly to the height level of the uppermost carding organ. This arrangement, in particular, renders unnecessary the expensive planar machining of the securing faces required heretofore for the pillow-block bearings. This arrangement according to the invention has the further advantage that the locations of support where the carding organs are to be secured on the lateral inner and outer faces of the side walls can be positively determined at the time the side walls are designed and may be provided therein by simple manufacturing operations. Thus, after marking, the apertures for the bearings or bolts may be provided by simply drilling holes through the side walls. This results in a very substantial simplification of production technology, leading to a more economical manufacture of the carding machine. The invention permits a particularly advantageous arrangement of the carding organs with respect to the side walls since, on the one hand, the shafts or securing elements of the carding organs may be directly mounted on the side walls and, on the other hand, the side walls can be arranged immediately adjacent the end faces of the movable or stationary carding organs, whereby dust accumulation and lateral fly can effectively be avoided.

By virtue of the fact that the end faces of the carding organs are arranged immediately adjacent the inner faces of the side walls and thus only a minimum intermediate space is present, maintenance, emptying and cleaning of the card are, in addition, significantly simplified and rendered easier. Further, the invention provides that the drives for the moving carding organs are secured externally of the side walls and the side walls serve as a common support for all the drives. As a result, by virtue of the simple arrangement of the side walls with respect to the carding organs, a very substantial simplification of manufacture is coupled with an effective shrouding of the carding organs.

In addition to protecting the cylinder against lateral fly, the side walls, among others, serve for receiving the flexible bends, front and back bends, the adjusting devices for these components as well as the adjusting devices for the cylinder grid, the stationary points for the lickerin and the adjustment for the doffer, the stationary points for the grinding and ejecting device and further serves as connecting component for the feeding organs and the web delivery unit.

The intermediate space between the lateral end faces of the carding organs and the side walls will be particularly narrow if the shaft bearings are mounted (for example by means of a screw connection) on the outer lateral surfaces of the side walls. Advantageously, the bearings for the cylinder are additionally supported, for example, by means of pedestals. In this manner, the substantial axle load of the stub shafts of the cylinder can be taken up in an effective manner.

Preferably, the side walls are steel plates in which reinforcing ribs or struts may be provided. Steel plates are stable, they are economical to manufacture and metal working operations are easy to perform thereon.

Expediently, the side walls of the machine frame are each one-piece components, so that during the prefabrication, all markings and apertures may be provided simultaneously or in a rapid sequence.

According to a preferred embodiment of the invention, however, the side walls are each multi-part components; this significantly simplifies the installation of the carding organs. Each side wall may be so divided that, for example, a lower and an upper wall part surrounds a bearing. Each side wall may also be composed of juxtapositioned wall portions. Such an embodiment makes possible the addition of further side wall portions, so that additional carding organs can be used for processing different types of fibers. Thus, the card may be extended in a simple manner by means of additional structural components and stages.

Expediently, the side walls completely shroud the end faces of the carding organs, for example, they cover the entire lateral face of the cylinder and the traveling flats, ensuring a particularly effective protection. Such shrouding extends from the base plate to the outermost upper limit of the carding organs.

In accordance with a further advantageous feature of the invention, the side walls are held together by additional connecting elements which are designed as auxiliary components for maintaining a fixed distance between the side walls and serve, for example, as clothing, material removal hood, feeding table, fixed flats or guide for traveling flats.

BREIF DESCRIPTION OF THE DRAWINGS

FIG. 1 is a schematic side elevational view of a preferred embodiment of the invention.

FIG. 1*a* is a schematic side elevational view of a modification of the same embodiment.

DESCRIPTION OF THE PREFERRED EMBODIMENTS

Figure 1:
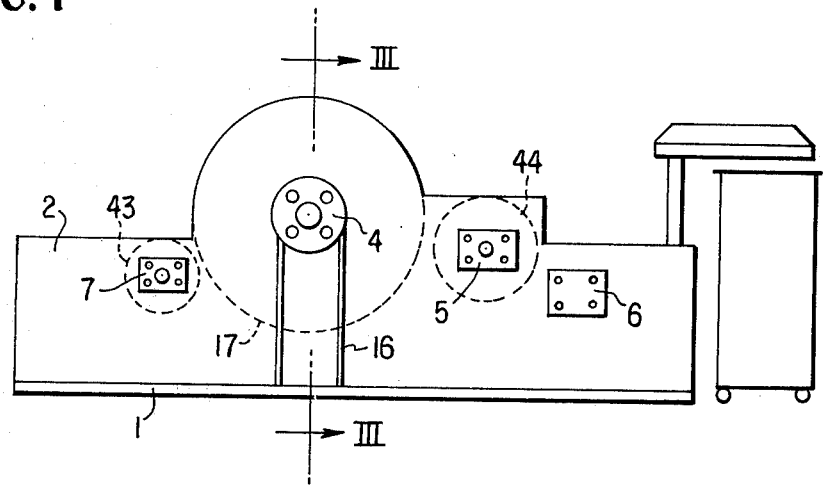
Figure 1A:
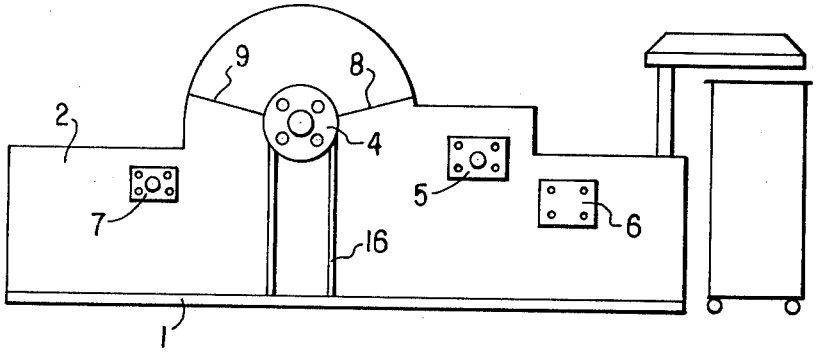
Figure 3:
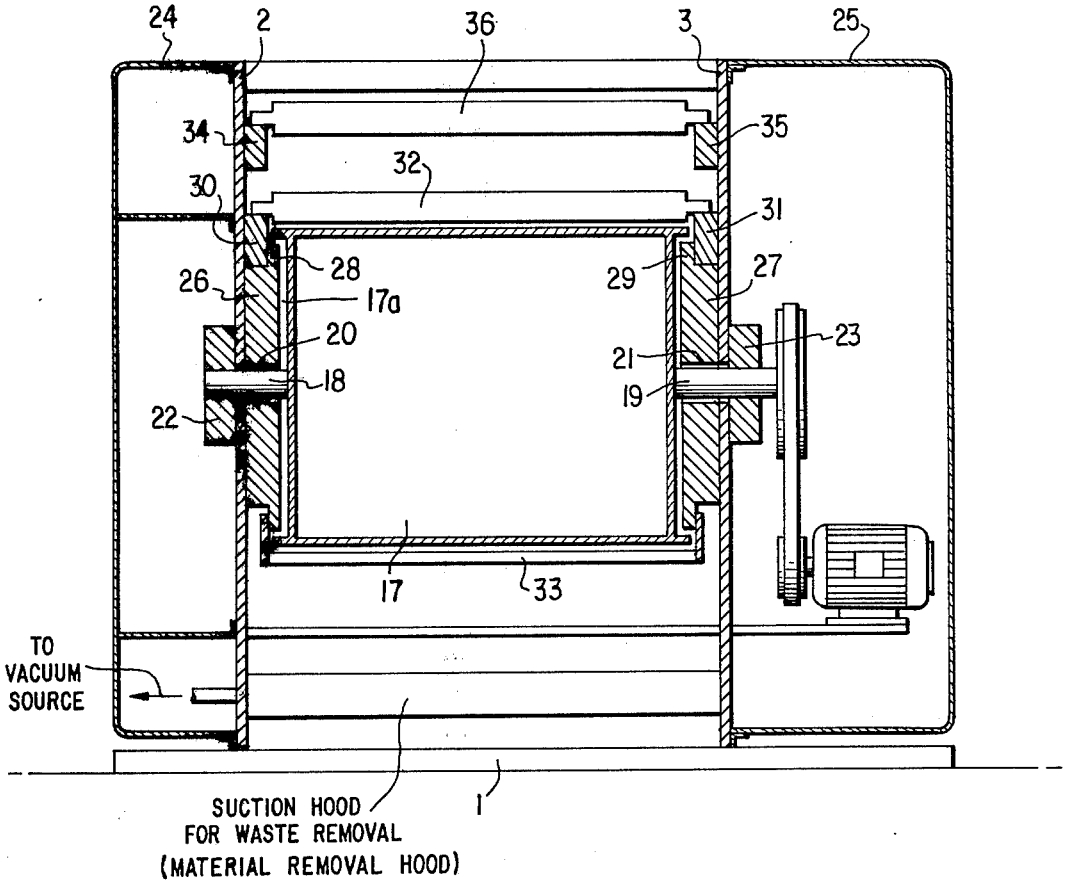
FIG. 3 is an enlarged front elevational sectional view taken along line III—III of FIG. 1.

Turning now to FIGS. 1, 1*a* and 3, on a base plate 1 there are arranged vertically oriented, parallel-spaced side walls 2 and 3 each being constituted as a one-piece member extending from the base plate 1 to the upper limits of the card. To the lateral surface of the side walls 2 and 3 there are affixed bearings 4, 5, 6 and 7 for the cylinder 17, the doffer 44, the web delivering assembly (not shown) and the lickerin 43, respectively. The stub shafts of each of these carding organs, journalling in the bearings 4-7, extend through the side walls 2 and 3 through openings provided therein. While, as noted, each side wall 2 and 3 may be entirely a one-piece member, it is expedient if each side wall has, in the zone of the cylinder, a relatively small top portion bounded by parting lines 8 and 9 as illustrated in FIG. 1*a*. Such an arrangement significantly facilitates the mounting of the cylinder bearing 4. The side walls 2 and 3 may be provided with reinforcing elements such as vertical, spaced ribs 16.

Figure 2:
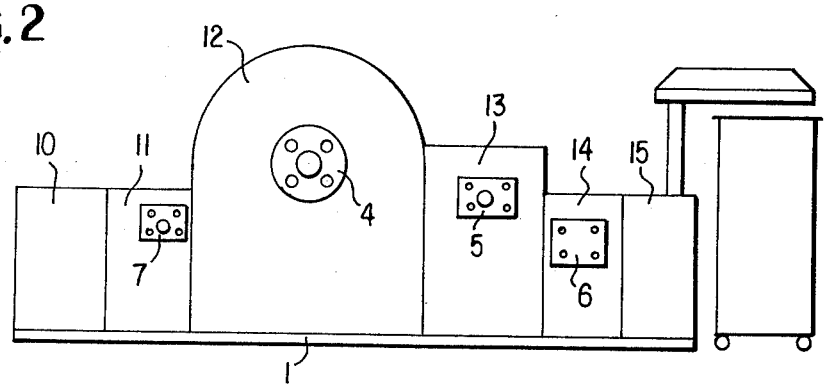
FIG. 2 is a schematic side elevational view of another preferred embodiment of the invention.

FIG. 2 shows a card in which the two side walls (only one is visible in FIG. 2) arranged on the base plate 1 are each formed of a plurality of side wall portions 10, 11, 12, 13, 14 and 15. The parting lines between the side wall portions 10–15 extend vertically. This embodiment provides that structural units may be positioned side by side or behind one another as modules.

Figure 4:
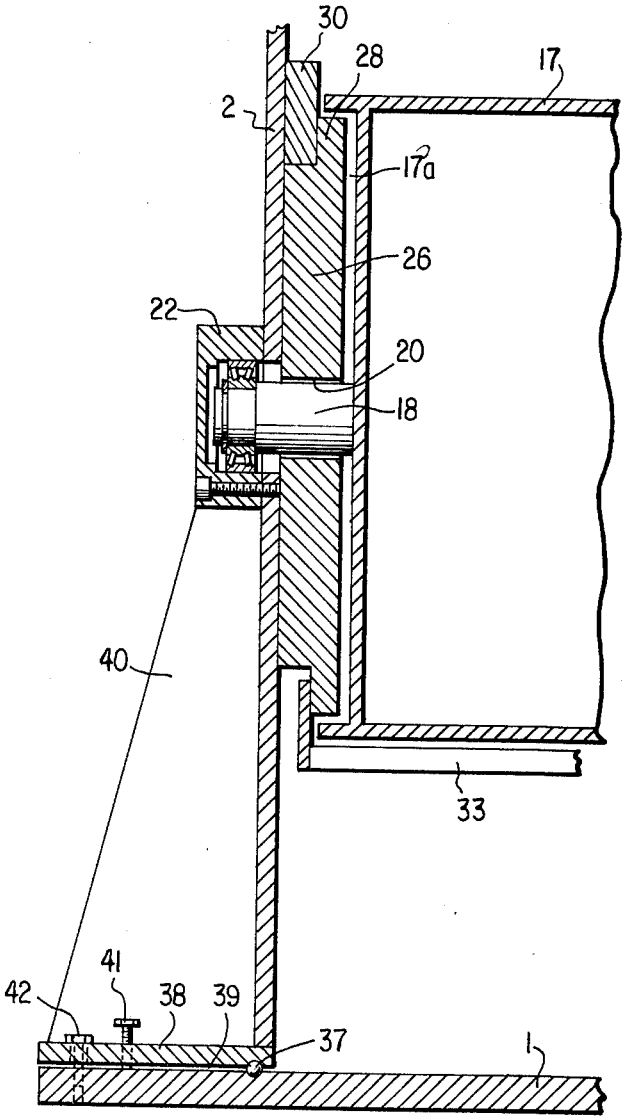
FIG. 4 is a front elevational sectional view, on an enlarged scale, of a modified detail of FIG. 3.

Turning once again to FIG. 3 and also referring to FIG. 4, the main cylinder 17 of the card is rotatably supported between the side walls 2 and 3 which extend from the base plate 1 up to the highest point of the revolving flats. The stub shafts 18 and 19 of the cylinder 17 extend through bores 20 and 21 provided in the side walls 2 and 3 and are supported in bearings 22 and 23 which are mounted (for example, bolted) on the respective outer lateral surface of the side walls 2 and 3. A closure 24 is arranged externally of and spaced from the side wall 2 to define therewith a space in which, for example, a dust removing device may be disposed. At the outer lateral face of the side wall 3, on the other hand, a closure 25 defines a space which accommodates the driving components for the rotary carding organs.

Between each side wall 2 or 3 and the respective lateral end face of the cylinder 17 there are provided disc-like circular flanges 26, 27 which constitute integral parts of the respective side walls 2 and 3. This arrangement provides that the end faces of the cylinder 17 are situated very closely to the side walls 2 and 3. The flanges 26 and 27 extend into a recessed cylindrical space 17*a* at the end faces of the cylinder 17 and substantially fill out the same. The flanges 26, 27 have central openings through which the stub shafts 18 and 19 of the cylinder 17 extend. Each flange 26 and 27 further has, at its side oriented away from the respective side wall 2 or 3 to which it is attached, annular enlargements 28 and 29 which serve for securing carding organs, such as the cylinder grid 33 and the flexible bends 30 and 31 for the flat bars 32 (only one shown). Above the flexible bends 30 and 31 and the flat bars 32, return bends 34 and 35 which support the flat bars 36 (only one shown) are secured to the side walls 2 and 3, for example, by means of threaded bolts.

Further, referring to FIG. 4, on the base cylinder 1, in a face-to-face relationship therewith, there is positioned a support plate 38 with the interposition of a cylindrical rod 37. The side wall 2 is positioned on the support plate 38 in a vertical orientation. The bearing assembly 22 is inserted in a circular aperture of the side wall 2. The bearing assembly 22 extends beyond the outer face of the side wall 2 and is backed up by a bearing pedestal 40 which is secured, for example, by welding to the support plate 38 and the side wall 2. The rod 37 is horizontally supported in groove-like recesses provided in the base plate 1 and the support plate 38. The depth of the groove-like recesses is so designed that a clearance 39 is maintained between the base plate 1 and the support plate 38. The recesses and the rod 37 are located, for example, in that zone of the support plate 38 which is oriented towards the side wall 2. On that side of the base plate 1 which is oriented away from the side wall 2, there are provided a set screw 41 and a securing screw 42 which pass perpendicularly through the support plate 38. The securing screw is received in a complemental thread provided in the base plate 1. The structure shown in FIG. 4 and described in connection with the side wall 2 is duplicated at the opposite side wall 3.

The base plate 1, the support plate 38, the bearing pedestal 40 and the flange 26, together with the like components at the other side wall 3 form a central unit. During assembly of the carding machine, first the base plate 1 is assembled with the support plate 38 and the bearing pedestal 40 and aligned by means of the set screw 41. Thereafter the cylinder 17, together with the flanges 26 and 27 is inserted into the central unit. In this manner, a stable support for the cylinder 17 is effected. Only thereafter are the side walls 2 and 3 inserted and secured. Subsequently, the other carding organs are secured to the side walls 2 and 3 and to the flanges 26 and 27 integral therewith.

It is to be understood that the above description of the present invention is susceptible to various modifications, changes and adaptations, and the same are intended to be comprehended within the meaning and range of equivalents of the appended claims.

What is claimed is:

1. In a card having a frame including two parallel-spaced, rigidly supported side walls having lateral surfaces; a lickerin and a doffer disposed between the side walls and mounted on the lateral surfaces thereof; carding organs having lateral end faces and situated between the lickerin and the doffer; said carding organs including a main cylinder; the improvement wherein said main cylinder is, with its lateral end faces, disposed immediately adjacent the lateral surface of the respective side wall and is laterally mounted in said side walls; the improvement further comprising a flange member affixed face-to-face to each side wall between each respective lateral end face to said main cylinder and the respective side wall adjacent thereto.

2. A card as defined in claim 1, further comprising bearings mounted on external surfaces of said side walls for supporting said main cylinder for rotation.

3. A card as defined in claim 2, and further comprising means for additionally supporting said bearings associated with said main cylinder.

4. A card as defined in claim 1, wherein said side walls are reinforced steel plates.

5. A card as defined in claim 1, wherein each lateral end face of said main cylinder has a cylindrical depression into which the respective flange projects.

6. A card as defined in claim 1, wherein each said side wall is a one-piece member.

7. A card as defined in claim 1, wherein each side wall is a unitary component formed of a plurality of side wall portions affixed to one another.

8. A card as defined in claim 7, wherein between said side wall portions vertical parting lines are provided.

9. A card as defined in claim 1, wherein said side walls laterally entirely cover the lateral end faces of the carding organs of said card.

10. A card as defined in claim 1, further comprising coupling elements connecting one side wall to the other for holding said side walls together; said coupling elements being auxiliary carding organs of said card.

* * * * *